US012203156B2

(12) United States Patent
Bordereau

(10) Patent No.: US 12,203,156 B2
(45) Date of Patent: Jan. 21, 2025

(54) FORGED PART OF BAINITIC STEEL AND A METHOD OF MANUFACTURING THEREOF

(71) Applicant: ArcelorMittal, Luxembourg (LU)

(72) Inventor: Victor Bordereau, Montigny-les-metz (FR)

(73) Assignee: ArcelorMittal, Luxembourg (LU)

( * ) Notice: Subject to any disclaimer, the term of this patent is extended or adjusted under 35 U.S.C. 154(b) by 0 days.

(21) Appl. No.: 16/980,982

(22) PCT Filed: Mar. 15, 2019

(86) PCT No.: PCT/IB2019/052125
§ 371 (c)(1),
(2) Date: Sep. 15, 2020

(87) PCT Pub. No.: WO2019/180563
PCT Pub. Date: Sep. 26, 2019

(65) Prior Publication Data

US 2021/0010117 A1 Jan. 14, 2021

(30) Foreign Application Priority Data

Mar. 23, 2018 (WO) ..... PCT/IB2018/051970

(51) Int. Cl.
*C22C 38/54* (2006.01)
*C21D 6/00* (2006.01)
(Continued)

(52) U.S. Cl.
CPC ..... *C22C 38/54* (2013.01); *C21D 6/004* (2013.01); *C21D 6/005* (2013.01); *C21D 6/008* (2013.01);
(Continued)

(58) Field of Classification Search
CPC ..... C21D 1/19; C21D 1/20; C21D 2211/001; C21D 2211/002; C21D 2211/008;
(Continued)

(56) References Cited

U.S. PATENT DOCUMENTS 5,820,706 A 10/1998 Bellus et al.
6,159,312 A 12/2000 Koo et al.
(Continued)

FOREIGN PATENT DOCUMENTS

EP 2103704 A1 9/2009
JP H1112678 A 1/1999
(Continued)

OTHER PUBLICATIONS

NPL: On-line translation of JP 01112678 A1, Jan. 1999 (Year: 1999).*
(Continued)

*Primary Examiner* — Jie Yang
(74) *Attorney, Agent, or Firm* — Davidson Kappel LLC

(57) ABSTRACT

A steel for forging mechanical parts including of the following elements, expressed in percentage by weight: 0.15%≤C≤0.22%; 1.6%≤Mn≤2.2%; 0.6%≤Si≤1%; 1%≤Cr≤1.5%; 0.01%≤Ni≤1%; 0%≤S≤0.06%; 0%≤P≤0.02%; 0%≤N≤0.013%; and having optional elements 0%≤Al≤0.06%; 0.03%≤Mo≤0.1%; 0%≤Cu≤0.5%; 0.01%≤Nb≤0.15%; 0.01%≤Ti≤0.03%; 0%≤V≤0.08%; 0.0015%≤B≤0.004%; the remainder composition being composed of iron and unavoidable impurities caused by processing, the microstructure of said steel having microstructure by area percentage including of cumulative presence of residual austenite and martensite-austenite island between 1% and 20%, the remaining microstructure being bainite having at least 80%, wherein the fraction of grain boundaries of bainite with a misorientation angle of 59.5°
(Continued)

are at least 7% and with an optional presence of martensite between 0% and 10%.

20 Claims, 2 Drawing Sheets

(51) Int. Cl.

| | |
|---|---|
| ***C21D 7/13*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |

(52) U.S. Cl.
CPC ..... *C21D 7/13* (2013.01); *C21D 8/021* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C21D 2211/001* (2013.01); *C21D 2211/002* (2013.01); *C21D 2211/008* (2013.01)

(58) Field of Classification Search
CPC ..... C21D 6/004; C21D 6/005; C21D 6/008; C21D 7/13; C21D 8/021; C22C 38/02; C22C 38/04; C22C 38/58
USPC ..... 148/328
See application file for complete search history.

(56) References Cited

U.S. PATENT DOCUMENTS

| | | | | |
|---|---|---|---|---|
| 8,585,835 | B2 * | 11/2013 | Sugimoto ..... | C21D 8/10 148/590 |
| 10,174,392 | B2 | 1/2019 | Haga et al. | |
| 2011/0209803 | A1 | 9/2011 | Usui et al. | |
| 2012/0267012 | A1 | 10/2012 | Sohn et al. | |
| 2013/0037182 | A1 | 2/2013 | Sourmail | |
| 2014/0241933 | A1 | 8/2014 | Haga et al. | |
| 2015/0075680 | A1 | 3/2015 | Tanaka et al. | |
| 2016/0237520 | A1 | 8/2016 | Murata et al. | |
| 2018/0057909 | A1 | 3/2018 | Perrot et al. | |
| 2018/0245172 | A1 | 8/2018 | Yuya et al. | |

FOREIGN PATENT DOCUMENTS

| | | | |
|---|---|---|---|
| JP | 2009191364 | A | 8/2009 |
| RU | 2560479 | C1 | 8/2015 |
| RU | 2563397 | C2 | 9/2015 |
| WO | WO 2009/102848 | A1 | 8/2009 |
| WO | WO2010050619 | A1 | 5/2010 |
| WO | WO2012120020 | A1 | 9/2012 |
| WO | WO2016/063224 | | 4/2016 |
| WO | WO2016148206 | A1 | 9/2016 |
| WO | WO2017050790 | A1 | 3/2017 |

OTHER PUBLICATIONS

International Search Report of PCT/IB2019/052125 , May 17, 2019.
A.-F. Gourgues et al.: 11 Electron backscattering diffraction study of acicular ferrite, bainite, and martensite steel microstructures Materials Science and Technology, vol. 16, No. 1, Jan. 19, 2000 (Jan. 19, 2000), pp. 26-40.

* cited by examiner

FORGED PART OF BAINITIC STEEL AND A METHOD OF MANUFACTURING THEREOF

The present invention relates to bainitic steel suitable for forging mechanical parts of steel for automobiles.

BACKGROUND

Automotive parts are required to satisfy two inconsistent necessities, namely ease of forming and strength, but in recent years a third requirement of improvement in fuel consumption has been added for automobiles in view of global environment concerns. Thus, now automotive parts must be made of material having high formability to fit in the criteria of ease of fit in the intricate automobile assembly and at same time to improve strength for vehicle's engine crashworthiness and durability while reducing weight of vehicle to improve fuel efficiency.

Therefore, intense research and development endeavors are undertaken to reduce the amount of material utilized in car by increasing the strength of material. Conversely, an increase in strength of steel decreases formability, and thus development of materials having high strength, high impact toughness as well as high formability is necessitated.

Earlier research and developments in the field of high strength and high impact toughness have resulted in several methods for producing high strength and high impact toughness steel, some of which are enumerated herein for conclusive appreciation of the present invention:

US2013/0037182 claims bainitic steel for the manufacturing of a mechanical part with the following chemical composition in weight percentages: 0.05%≤C≤0.25%, 1.2≤Mn≤2%, 1%≤Cr≤2.5%, 0<Si≤1.55%, 0<Ni≤1%, 0<Mo≤0.5%, 0<Cu≤1%, 0<V≤0.3%, 0<Al≤0.1%, 0<B≤0.005%, 0<Ti≤0.03%, 0<Nb≤0.06%, 0<S≤0.1%, 0<Ca≤0.006%, 0<Te≤0.03%, 0<Se≤0.05%, 0<Bi≤0.05%, 0<Pb≤0.1%, the remainder of the steel part being iron and impurities resulting from processing. The steel of US2013/0037182 is not able to attain the yield strength of 800 MPa or more, further the steel does not possess the impact toughness value of 70 J·cm$^{-2}$ at 20° C. (KCU).

WO2016/063224 claims for a steel comprising of chemical composition in weight percentages: 0.1≤C≤0.25%, 1.2≤Mn≤2.5%, 0.5≤Si≤1.7%, 0.8≤Cr≤1.4%, 0.05≤Mn≤0.1, 0.05≤Nb≤0.10, 0.01≤Ti≤0.03%, 0<Ni≤0.4%, 0<V≤0.1%, 0<S≤0.03%, 0<P≤0.02%, 0<B≤30 ppm, 0<O≤15 ppm and the residual elements less than 0.4%. But in term of mechanical properties the tensile strength is below 1200 MPa, the yield strength never goes higher than 800 MPa and impact toughness is around 20 J in CVN.

SUMMARY OF THE INVENTION

An object of the invention is to provide a bainitic steel for hot forging of mechanical parts that makes it possible to obtain tensile strength above 1100 MPa and impact toughness 70 J·cm$^{-2}$ at 20° C. in DVM. The steel for forging mechanical parts comprising of the following elements, expressed in percentage by weight:

0.15%≤C≤0.22%;
1.6%≤Mn≤2.2%;
0.6%≤Si≤1%;
1%≤Cr≤1.5%;
0.01%≤Ni≤1%;
0%≤S≤0.06%;
0%≤P≤0.02%;
0%≤N≤0.013%;

and can contain one or more of the following optional elements

0%≤Al≤0.06%;
0.03%≤Mo≤0.1%;
0%≤Cu≤0.5%;
0.01%≤Nb≤0.15%;
0.01%≤Ti≤0.03%;
0%≤V≤0.08%;
0.0015%≤B≤0.004%;

the remainder composition being composed of iron and unavoidable impurities caused by processing, the microstructure of said steel having microstructure by area percentage comprising of cumulative presence of residual austenite and martensite-austenite island between 1% and 20%, the remaining microstructure being bainite having at least 80%, wherein the fraction of grain boundaries of bainite with a misorientation angle of 59.5° are at least 7% and with an optional presence of martensite between 0% and 10%.

The present invention provides a bainitic steel suitable for hot forging that simultaneously have:

an ultimate tensile strength greater than or equal to 1100 MPa and preferably above 1150 MPa, an impact toughness greater than or equal to 70 J·cm$^{-2}$ at 20° C.

a yield strength greater than or equal to 800 MPa and preferably above 850 Mpa.

In a preferred embodiment, the steel sheets according to the invention may also present a yield strength to tensile strength ratio of 0.72 or more.

Preferably, such steel is suitable for manufacturing forged steel parts having a cross section between 30 mm and 100 mm such as crankshaft, pitman arm and steering knuckle without noticeable hardness gradient between forged part skin and heart.

Another object of the present invention is also to make available a method for the manufacturing of these mechanical parts that is compatible with conventional industrial applications while being robust towards manufacturing parameters shifts.

DETAILED DESCRIPTION

Figure 1:
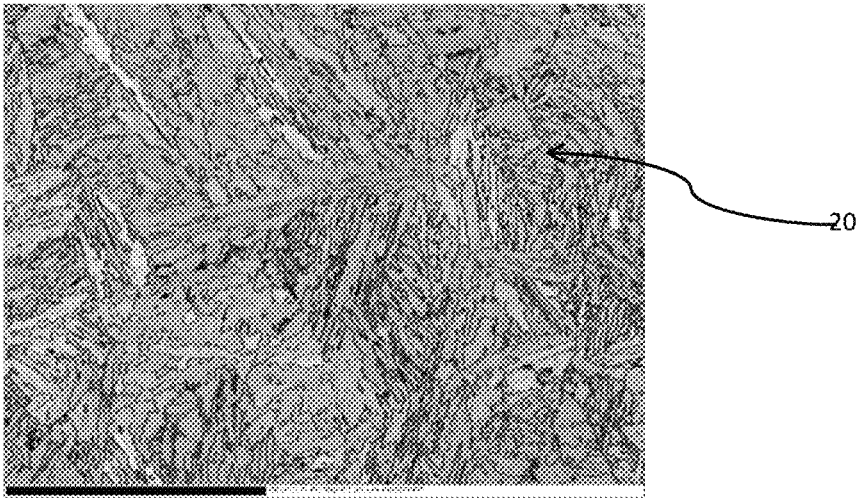
FIG. 1 shows the microstructure of trial I1 which is according to the invention.

Carbon is present in the steel of the present invention from 0.15% to 0.22%. Carbon imparts strength to the steel by solid solution strengthening and carbon is gammagenous hence delays the formation of Ferrite. Carbon is the element that has the impact on Bainitic start transformation temperature (Bs) and Martensitic start transformation temperature (Ms). Bainite transformed at low temperature exhibits better strength/ductility combination than bainite transformed at high temperature.

A minimum of 0.15% of carbon is required to reach a tensile strength of 1100 MPa but if carbon is present above 0.22%, carbon deteriorates ductility as well as machinability and weldability of the final product. The carbon content is advantageously in the range 0.15% to 0.20% to obtain simultaneously high strength and high ductility.

Manganese is added in the present steel between 1.6% and 2.2%. Manganese provides hardenability to the steel. It allows to decrease the critical cooling rate for which a bainitic or martensitic transformation can be obtained in continuous cooling without any prior transformation. It facilitates bainite transformation at low temperature. A minimum content of 1.6% by weight is necessary to obtain the desired bainite microstructure and also stabilizes austenite. But above 2.2%, manganese have negative effect on the steel of present invention as retained austenite after bainitic transformation is coarser and more likely to transform into martensite or MA constituents during the third step of cooling and these phases are detrimental for the requested properties. In addition manganese forms sulphides such as MnS. These sulphides can increase machinability if the shape and distribution are well controlled. If not, they might have a very detrimental effect on impact toughness.

Silicon is present in the steel of the present invention between 0.6% and 1%. Silicon imparts the steel of the present invention with strength through solid solution strengthening. Silicon reduces the formation of cementite nucleation as silicon hinders precipitation and diffusion-controlled growth of carbides by forming a Si-enriched layer around precipitate nuclei. Therefore austenite gets enriched in carbon which reduces the driving force during the bainitic transformation. As a consequence, addition of Si slows down the overall bainitic transformation kinetics which leads to an increase in the residual austenite content. Silicon additions may lead to the occurrence of cementite-free bainite that exhibits generally higher combination of strength and ductility than classical upper and lower bainite transformed in a same range of temperatures. Further silicon also acts as a deoxidizer. A minimum of 0.6% of silicon is required to impart strength to the steel of the present invention and to provide cementite-free bainite under continuous cooling. An amount of more than 1% raises the activity of carbon in austenite promoting its transformation into pro-eutectoid ferrite, which can deteriorate the strength, but also limits too much the extension of the bainite transformation, resulting in too much retained austenite at the end of the bainitic transformation and thus too many martensite and MA constituents at the end of the cooling.

Chromium is present between 1% and 1.5% in the steel of present invention. Chromium is an indispensable element in order to produce a bainite and also promote the stabilization of Austenite. Addition of Chromium promotes homogeneous and finer bainite microstructure during the temperature range between Bs+30° C. and Bs+50° C. A minimum content of 1% of Chromium is required to produce the targeted bainitic microstructure but the presence of Chromium content of 1.5% or more promote the formation of martensite from retained austenite during the temperature range Ms and Ms+60° C. Another reason to keep the Chromium level below 1.5% is that above 1.5% of Chromium causes segregation.

Nickel is contained between 0.01% and 1%. It is added to contribute towards hardenability and toughness of steel. Nickel also assists in lowering the bainite start temperature. However its content is limited to 1%, due to the economic feasibility.

Sulphur is contained between 0% and 0.06%. Sulphur forms MnS precipitates which improve the machinability and assists in obtaining a sufficient machinability. During metal forming processes such as rolling and forging, deformable manganese sulfide (MnS) inclusions become elongated. Such elongated MnS inclusions can have considerable adverse effects on mechanical properties such as tensile strength and impact toughness if the inclusions are not aligned with the loading direction. Therefore sulfur content is limited to 0.06%. A preferable range the content of Sulphur is 0.03% to 0.04%.

Phosphorus is an optional constituent of the steel of the present invention and is between 0% and 0.02%. Phosphorus reduces the spot weldability and the hot ductility, particularly due to its tendency to segregate at the grain boundaries or co-segregate with manganese. For these reasons, its content is limited to 0.02% and preferably is lower than 0.015%.

Nitrogen is in an amount between 0% and 0.013% in steel of the present invention. Nitrogen forms nitrides with Al, Nb, and Ti, which prevent the austenite structure of the steel from coarsening during hot forging, and enhance the toughness thereof. An efficient use of TiN to pin austenite grain boundaries is achieved when the Ti content lies between 0.01% and 0.03% together with a Ti/N ratio <3.42. Using an over-stoichiometric nitrogen content leads to an increase in the size of these particles, this is not only less efficient to pin the austenite grain boundaries but also increases the probability for TiN particles to act as fracture initiation sites.

Aluminum is an optional element for the steel of the present invention. Aluminum is a strong deoxidizer and also forms precipitates dispersed in the steel as nitrides which prevent the austenite grain growth. But the deoxidizing effect saturates for aluminum content in excess of 0.06%. A content of more than 0.06% can lead to the occurrence of coarse aluminum-rich oxides that deteriorate tensile properties and especially impact toughness.

Molybdenum is present between 0.03% and 0.1% in the present invention. Molybdenum forms $Mo_2C$ precipitates which increase the yield strength of steel of the present invention. Molybdenum has also an effect on steel hardenability. Solute Molybdenum substantially impedes the growth of bainite laths, making the bainite laths finer. Such an effect is only feasible with a minimum of 0.03% of molybdenum. The excessive addition of molybdenum increases the alloying cost and the formation of MA constituents from retained austenite will be enhanced. Moreover, segregation issue can appears if Mo content is too high. Thus molybdenum is restricted to 0.1% for the present invention.

Copper is a residual element coming from electrical arc furnace steel making process and must be kept as low as 0% but it must be always kept below 0.5%. Over this value, the hot workability decreases significantly.

Niobium is present in the steel of the present invention between 0.04% and 0.15%. Niobium is added to increase the steel hardenability by delaying strongly diffusive transformation when in solid solution. Niobium can also been used in synergy with boron, preventing boron to precipitate in boro-carbides along the grain boundaries, thanks to preferential precipitation of niobium carbo-nitrides. Moreover niobium is known to slow down recrystallization and austenite grain growth kinetics both in solid solution and in precipitates. The combined effect on austenite grain size and hardenability helps in refining the final bainite microstructure, thereby to increase strength and toughness of parts manufactured according to the present invention. It cannot be added to higher content than 0.15% wt to prevent the coarsening of niobium precipitates that can act as nuclei for ductile damaging and for ferrite transformation.

Titanium is present between 0.01% and 0.03%. Titanium prevents boron to form nitrides. Titanium precipitates as nitrides or carbo-nitrides in the steel that can efficiently pin austenite grain boundaries and so limit the austenite grain growth at high temperature. As the bainitic packet size is closely linked to the austenite grain size, addition of titanium is effective in improving toughness. Such effect is not obtained with titanium content of less than 0.01% and for content of more than 0.03% the effect tends to saturate, whereas only the alloy cost increases. In addition, the occurrence of coarse titanium nitrides formed during solidification is harmful for impact toughness and fatigue properties.

Vanadium is an optional element and present between 0% and 0.08%. Vanadium is effective in enhancing the strength of steel by forming carbides or carbo-nitrides and the upper limit is 0.08% due to the economic reasons.

Boron ranges from 0.0015 to 0.004%. Boron is usually added in very small quantity since only a few ppm can lead to significant structural changes. With this level of addition, boron has no effect in the bulk because of the very low ratio of boron atom per iron atom (generally <0.00005) and so does not lead to solid solution hardening or precipitation strengthening. In fact, boron strongly segregates at the austenite grain boundaries where, for large grain size, boron atoms can be as numerous as iron atoms. This segregation leads to the retardation of ferrite and pearlite formation that promotes bainitic or martensitic microstructures during cooling and thus increases the strength of such steels after austenite decomposition at moderate cooling rates. To allow and exhibit this effect, it is recommended to add B in an amount of 0.0015% or more. If not well protected by addition of Nb and/or Mo, precipitation of boro-carbides $M_{23}(B,C)_6$ Temperature <950° C. can occur at austenite grain boundaries. Coarse $M_{23}(B,C)_6$ are considered as ferrite precursors by some authors as they promote ferrite nucleation at their incoherent interfaces when they are sufficiently large. The effect of un-combined boron is obviously stronger than the one of boron trapped into carbides. So there is a necessity to maintain it un-combined in order to obtain bainitic or martensitic microstructures for moderate cooling rates. The best hardenability is obtained when the boron content ranges between 15 and 30 ppm for low carbon up to 0.2% steels. Higher boron content rapidly deteriorates the low temperature toughness of such steels, so an upper limit thereof is set at 0.004%.

Other elements such as Tin, Cerium, Magnesium or Zirconium can be added individually or in combination in the following proportions by weight: Tin ≤0.1%, Cerium ≤0.1%, Magnesium ≤0.010% and Zirconium ≤0.010%. Up to the maximum content levels indicated, these elements make it possible to refine the grain during solidification. The remainder of the composition of the Steel consists of iron and inevitable impurities resulting from processing.

The microstructure of the Steel sheet comprises:

Residual austenite and Martensite-Austenite islands constituent cumulatively present in an amount between 1% and 20% and are essential constituents of present invention. Preferentially the amount of residual austenite and MA constituents is advantageous between 5% and 20%. Residual austenite imparts ductility and Martensite austenite islands provide the strength to the steel of present invention. The residual austenite and Martensite Austenite islands are formed during cooling step two and three from prior austenite that remained untransformed during step two of cooling.

Figure 2:
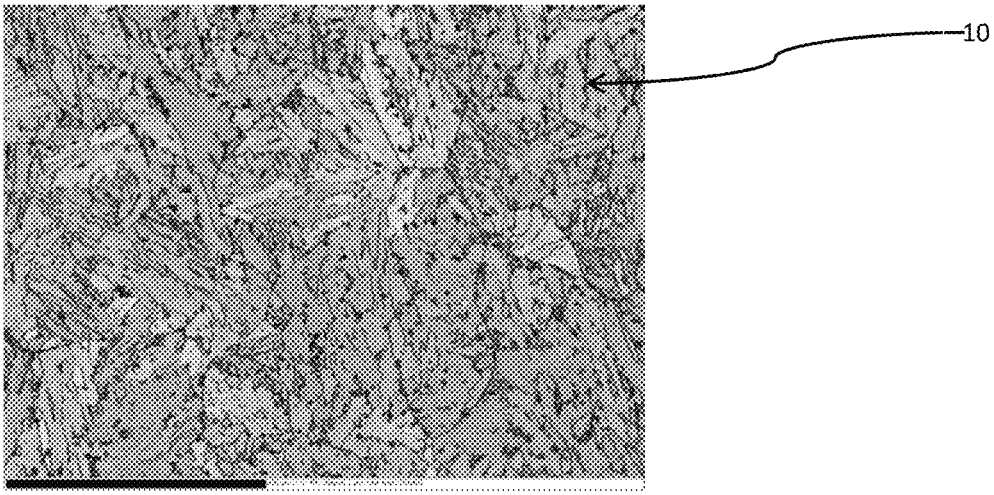
FIG. 2 shows the microstructure of trial R1 which is not according to the invention.
Figure 3:
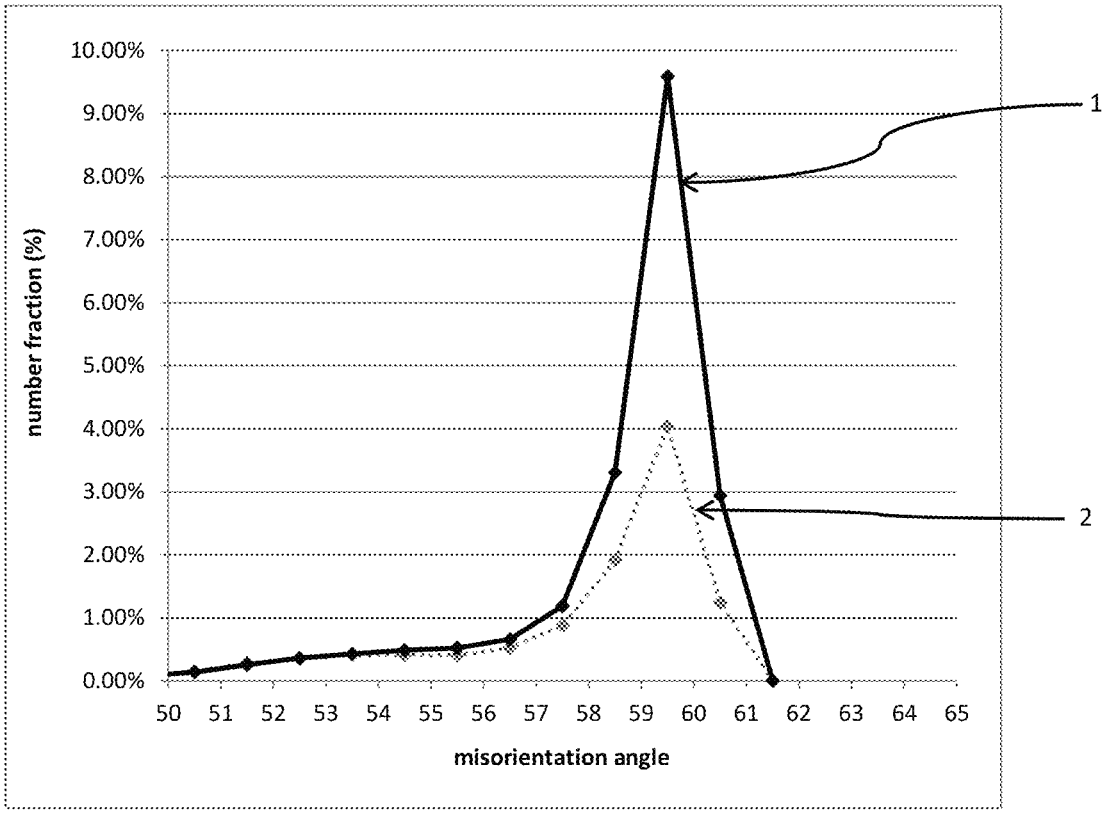
FIG. 3 shows a comparison between the presences of bainite grain boundaries misorientated at a misorientation angle of 59.5° of inventive steel and reference steel.

Bainite constitutes 80% or more of microstructure by area fraction for the steel of present invention and it is advantageous to have bainite more than 85%. In the present invention the micro-constituent Bainite have 7% or more bainite grain boundaries misorientated at a misorientation angle of 59.5° and preferably more than 9%. These misoriented bainitic grains imparts the steel of present invention with impact toughness. Bainite of present invention forms during cooling step two of cooling especially between 470° C. and Ms as Bainite formed in upper bainite range that is above 470° C. is coarse bainite which cannot have misoriented bainite grains more than 7% due its coarse size, hence to avoid the formation of coarse bainite higher cooling rates are preferred for cooling between T1 and T2, especially between T1 and 470° C. This is shown in FIG. 1 wherein FIG. 1 shows the microstructure of trial I1 which is according to the invention and FIG. 2 shows the microstructure of trial R1 which is not according to the invention. FIG. 2 contains bainite less than 80% by area ratio as well contain coarse bainite, designated by numeral 10 in FIG. 2, in comparison to the bainite of FIG. 1 in which bainite according to present is demonstrated by numeral 20. Further, FIG. 3 shows a comparison between the presences of bainite grain boundaries misorientated at a misorientation angle of 59.5° of inventive steel and reference steel. The curve designated by numeral 1 in FIG. 3 is of trial I1 which contain bainite grain boundaries misorientated at an misorientation angle of 59.5° at 9.6% whereas the curve designated by numeral 2 in FIG. 3 is of trial R1 which contain bainite grain boundaries misorientated at an misorientation angle of 59.5° at 4%.

The steel of the invention contains martensite from traces to a maximum of 10%. Martensite is not intended to be part of the invention but forms as a residual microstructure due to the processing of steel. The content of martensite must be kept as low as possible and must not exceed 10%. Up to a constituent percentage of 10% martensite imparts the steel of present invention with strength but when the presence of martensite exceeds 10% it diminishes the machinability of the steel part.

In addition to the above-mentioned microstructure, the microstructure of the mechanical forged part is free from microstructural components such as pearlite and cementite.

A mechanical part according to the invention can be produced by any suitable hot forging process, for example drop forging, press forging, upset forging and roll forging, in accordance with the stipulated process parameters explained hereinafter.

A preferred exemplary method is demonstrated herein but this example does not limit the scope of the disclosure and the aspects upon which the examples are based. Additionally, any examples set forth in this specification are not intended to be limiting and merely set forth some of the many possible ways in which the various aspects of the present disclosure may be put into practice.

A preferred method consists in providing a semi-finished casting of steel with a chemical composition according to the invention. The casting can be done in any form such as ingots or blooms or billets which is capable of being forged in mechanical part that possess a cross section diameter between 30 mm and 100 mm.

For example, the steel having the above-described chemical composition is casted in to a bloom and then rolled in form of a bar which will act as a semi-finished product. Several operations of rolling can be achieved to obtain the desired semi-finished product.

The semi-finished product after the casting process can be used directly at a high temperature after the rolling or may be first cooled to room temperature and then reheated for hot forging. Reheating of the semi-finished product can be between a temperature 1150° C. and 1300° C.

The temperature of the semi-finished product, which is subjected to hot forging, is preferably at least 1150° C. and must be below 1300° C. because the temperature of the semi-finished product is lower than 1150° C., excessive load is imposed on forging dies and, further, the temperature of the steel may decrease to a Ferrite transformation temperature during finishing forging, whereby the steel will be forged in a state in which transformed Ferrite contained in the structure. Therefore, the temperature of the semi-finished product is preferably sufficiently high so that hot forging can be completed in the austenitic temperature range. Reheating at temperatures above 1300° C. must be avoided because they are industrially expensive.

A final finishing forging temperature above 915° C. is preferred to have a structure that is favorable to recrystallization and forging. It is necessary to have final forging to be performed at a temperature greater than 915° C., because below this temperature the steel sheet exhibits a significant drop in forging. The hot forged part is thus obtained in this manner and then this hot forged steel part is cooled in a three step cooling process.

In the three step cooling process of the hot forged part, the hot forged part is cooled at different cooling rates between different temperature ranges.

In step one of cooling, the hot forged part is cooled from finishing forging to a temperature range between Bs+50° C. and Bs+30° C., herein also referred as T1 at an average cooling rate between 0.2° C./s and 10° C./s wherein it can be optionally held for time period between 0 s and 3600 s wherein during this step one of cooling it is preferred to have an average cooling rate between temperature range 750° C. and 780° C. to T1 between 0.2° C./s and 2° C./s.

Thereafter from temperature range T1, the second step cooling starts wherein the hot forged part is cooled from temperature range T1 to a temperature between Ms+60° C. and Ms, herein also referred as T2, at average cooling rate between 0.40° C./s and 2.0° C./s. In addition during the step two of cooling the cooling between T1 to a temperature range between 470° C. and 450° C. is preferably kept at an average cooling rate 1.0° C./s and 2.0° C./s to promote the transformation of Austenite into bainite and diminishes the possibility of forming the martensite.

In a third step the hot forged part is brought to room temperature from a temperature range between T2 wherein the average cooling rate during the third step is kept below 0.8° C./s and preferably 0.5° C./s and more preferably below 0.2° C./s. These average cooling rates are chosen in order to perform homogenous cooling across the cross-section of the hot forged part.

After completion of the third step of cooling the forged mechanical part is obtained.

For all the steps of cooling the Bs and Ms Temperatures are calculated for the present steel by using the following formula:

$$Bs=962-288C-84Mn-81Si-6Ni-95Mo-153Nb+108Cr^2-269Cr \quad Ms=539-423C-30Mn-18Ni-12Cr-11Si-7Mo$$

wherein the elements contents are expressed in weight percent.

EXAMPLES

The following tests, examples, figurative exemplification and tables which are presented herein are non-restricting in nature and must be considered for purposes of illustration only, and will display the advantageous features of the present invention.

Forged mechanical part made of steels with different compositions is gathered in Table 1, where the forged mechanical part is produced according to process parameters as stipulated in Table 2, respectively. Thereafter Table 3 gathers the microstructures of the forged mechanical part obtained during the trials and table 4 gathers the result of evaluations of obtained properties.

TABLE 1

| Steel Sample | C | Mn | Si | Cr | Ni | S | P | N | Al | Mo | Cu | Nb | Ti | V | B |
|---|---|---|---|---|---|---|---|---|---|---|---|---|---|---|---|
| 1 | 0.18 | 1.78 | 0.77 | 1.11 | 0.46 | 0.015 | 0.009 | 0.012 | 0.020 | 0.083 | 0.015 | 0.057 | 0.027 | 0.003 | 0.002 |
| 2 | 0.17 | 1.82 | 0.75 | 1.38 | 0.15 | 0.022 | 0.011 | 0.005 | 0.011 | 0.083 | 0.012 | 0.044 | 0.013 | 0.004 | 0.002 |
| 3 | 0.17 | 1.79 | 0.92 | 1.42 | 0.08 | 0.023 | 0.015 | 0.005 | 0.005 | 0.085 | 0.022 | 0.050 | 0.022 | 0.006 | 0.004 |

TABLE 2

| | | Step 1 | | | | Step 2 | | | | Step 3 | | |
|---|---|---|---|---|---|---|---|---|---|---|---|---|
| Steel Sample | Trials | Average Cooling rate in between hot forging finish to T1 (° C./s) | Average cooling rate in between from −780-750° C. to T1 (° C./s) | Temperature between T1 (° C.) | Time of holding at T1 (s) | Average Cooling rate from T1 to T2 (° C./s) | Average cooling rate from T2 to 470° C.-450° C. (° C./s) | T2 (° C.) | Time of holding at T2 (s) | Average cooling rate from T2 to room temperature (° C./s) | Bs (° C.) | Ms (° C.) |
| 1 | I1 | 0.8 | 0.5 | 550 | 0 | 0.9 | 1.7 | 400 | 0 | 0.1 | 514 | 380 |
| 2 | I2 | 0.6 | 0.4 | 550 | 0 | 1.0 | 2.2 | 385 | 0 | 0.1 | 518 | 385 |
| 3 | I3 | 1.3 | 1.0 | 550 | 0 | 1.3 | 2.6 | 385 | 0 | 0.1 | 508 | 384 |
| 1 | R1 | 1.9 | 1.2 | 550 | 0 | 0.3 | 0.5 | 400 | 0 | 0.1 | 514 | 380 |
| 2 | R2 | 0.6 | 0.4 | 550 | 0 | 0.2 | 0.2 | 400 | 0 | 0.1 | 518 | 385 |
| 3 | R3 | 0.6 | 0.4 | 550 | 0 | 0.2 | 0.2 | 400 | 0 | 0.1 | 508 | 384 |

Table 2 gathers the process parameters implemented on semi-finished product made of steels of Table 1 after being reheating between 1150° C. and 1300° C. and then hot forging which finishes above 915° C. The Steel compositions I1 to I3 serve for the manufacture of forged mechanical part according to the invention. This table also specifies the reference forged mechanical parts which are designated in table from R1 to R3. Table 2 also shows tabulation of Bs and Ms. These Bs and Ms are defined for the inventive steels and reference steels as follows:

$$Bs(°\ C.)=962-288C-84Mn-81Si-6Ni-95Mo-153Nb+108Cr^2-269Cr$$

$$Ms(°\ C.)=539-423C-30Mn-18Ni-12Cr-11Si-7Mo$$

wherein the elements contents are expressed in weight percent.

The table 2 is as follows:

I=according to the invention; R=reference; underlined values: not according to the invention.

T1=temperature range between Bs+50° C. and Bs+30° C.

T2=temperature range between Ms+60° C. and Ms

TABLE 3

| Steel Sample | Trials | Bainite (%) | Residual austenite + MA(%) | Martensite(%) | % boundaries exhibiting a misorientation angle of 59.5° |
|---|---|---|---|---|---|
| 1 | I1 | 89 | 10 | 1 | 9.6 |
| 2 | I2 | 88 | 11 | 1 | 14.5 |
| 3 | I3 | 86 | 5 | 9 | 10.2 |
| 1 | R1 | 74 | 22 | 4 | 4.0 |
| 2 | R2 | 72 | 25 | 3 | 5.0 |
| 3 | R3 | 73 | 23 | 4 | 3.2 |

Table 3 exemplifies the results of the tests conducted in accordance with the standards on different microscopes such as Scanning Electron Microscope for determining the microstructures of both the inventive and reference steels in terms of area fraction. The measurement of the percentage of misoriented grain boundaries is done by EBSD in which relative frequency for the bainitic grains is measured in misorientation profile.

The results are stipulated herein:

I=according to the invention; R=reference; underlined values: not according to the invention.

Table 4

Table 4 exemplifies the mechanical properties of both the inventive steel and reference steels. In order to determine the tensile strength, yield strength tensile tests are conducted in accordance of NF EN ISO 6892-1 standards. Tests to measure the impact toughness for both inventive steel and reference steel are conducted in accordance of EN ISO 148-1 at 20° C. on U-notched standard DVM specimen.

The results of the various mechanical tests conducted in accordance to the standards are gathered

TABLE 4

| Steel Sample | Trial | YS (MPa) | UTS (MPa) | YS/TS | Impact toughness DVM 20° C. ($J \cdot cm^{-2}$) |
|---|---|---|---|---|---|
| 1 | I1 | 889 | 1175 | 0.76 | 150 |
| 2 | I2 | 947 | 1192 | 0.79 | 95 |
| 3 | I3 | 912 | 1213 | 0.75 | 92 |
| 1 | R1 | 776 | 1147 | 0.68 | 67 |

TABLE 4-continued

| Steel Sample | Trial | YS (MPa) | UTS (MPa) | YS/TS | Impact toughness DVM 20° C. ($J \cdot cm^{-2}$) |
|---|---|---|---|---|---|
| 2 | R2 | 782 | 1163 | 0.67 | 55 |
| 3 | R3 | 763 | 1170 | 0.63 | 48 |

I=according to the invention; R=reference; underlined values: not according to the invention.

What is claimed is:

1. A steel for forging mechanical parts comprising a composition of the following elements, expressed in percentage by weight:

0.15%≤C≤0.22%;
1.6%≤Mn≤2.2%;
0.6%≤Si≤1%;
1%≤Cr≤1.5%;
0.01%≤Ni≤1%;
0%≤S≤0.06%;
0%≤P≤0.02%;
0%≤N≤0.013%;

and optionally one or more of the following elements in percentage by weight:

0%≤Al≤0.06%;
0.03%≤Mo≤0.1%;
0%≤Cu≤0.5%;
0.01%≤Nb≤0.15%;
0.01%≤Ti≤0.03%;
0%≤V≤0.08%;
0.0015%≤B≤0.004%
0%≤Sn≤0.1%;
0%≤Ce≤0.1%;
0%≤Mg≤0.010%;
0%≤Zr≤0.010%;

a remainder of the composition being composed of iron and unavoidable impurities caused by processing, a microstructure of the steel by area percentage comprising a cumulative presence of residual austenite and martensite-austenite islands between 1% and 20%, a remainder of the microstructure being bainite of at least 80%, wherein a fraction of grain boundaries of bainite with a misorientation angle of 59.5° being at least 7%, the microstructure having an optional presence of martensite between 0% and 10%, wherein the steel is in the form of a sheet having an impact toughness equal to or greater than 70 $J/cm^2$ and a yield strength of 889 MPa or more.

2. The steel as recited in claim 1 wherein the composition includes 0.7% to 1%, by weight, of silicon.

3. The steel as recited in claim 1 wherein the composition includes 0.15% to 0.2%, by weight, of carbon.

4. The steel as recited in claim 1 wherein the composition includes 0% to 0.05%, by weight, of aluminum.

5. The steel as recited in claim 1 wherein the composition includes 1.6% to 1.9%, by weight, of manganese.

6. The steel as recited in claim 1 wherein the composition includes 1.1% to 1.5%, by weight, of chromium.

7. The steel as recited in claim 1 wherein the bainite is more than or equal to 85%, by area percentage.

8. The steel as recited in claim 1 wherein a sum of residual austenite and martensite-austenite islands is between 1% and 15%, by area percentage.

9. A method for manufacturing structural or safety parts of a vehicle or an engine, comprising using the steel as recited in claim 1.

10. A vehicle comprising structural or safety parts or an engine manufactured according to the method as recited in claim 9.

11. The steel as recited in claim 1 wherein the impact toughness is equal to or greater than 90 J/cm$^2$.

12. A method of production of forged mechanical parts from the steel as recited in claim 1, the method comprising the following successive steps:

providing the steel composition in a form of a semi-finished product;

reheating said semi-finished product to a temperature between 1150° C. and 1300° C.;

hot forging the said semi-finished product in the austenitic range to a hot forging finishing temperature above 915° C. to obtain a hot forged part;

cooling the hot forged part in three step cooling, wherein in step one the hot forged part is cooled at cooling rate between 0.2° C./s and 10° C./s from the hot forging finishing temperature to a temperature range between Bs+50° C. and Bs+30° C. (T1) where the hot forged part can be held optionally for time between 0 s to 3600 s; thereafter in step two the hot forged part is cooled at average cooling rate between 0.40° C./s and 2° C./s from a temperature range between T1 to a temperature range between Ms+60° C. and Ms (T2); then in step three the hot forged part is cooled at an average cooling rate below 0.8° C./s from a temperature range between T2 to room temperature to obtain a forged mechanical part having the microstructure.

13. The method as recited in claim 12 wherein in the step one of cooling the hot forged part is cooled at an average cooling rate between 0.2° C./s and 2° C./s from a temperature range between 780° C. and 750° C. to a temperature range between T1 where the hot forged part can be held optionally for time between 0 s to 3600 s.

14. The method as recited in claim 12 wherein in the step two of cooling the hot forged part is cooled at an average cooling rate between 1.0° C./s and 2.0° C./s from a temperature range between T1 to a temperature range between 470° C. and 450° C.

15. The method as recited in claim 12 wherein in the step three the hot forged part is cooled at a cooling rate below 0.5° C./s from a temperature range between T2 to room temperature.

16. A method for manufacturing structural or safety parts of a vehicle or an engine, comprising using the forged mechanical part produced according to the method as recited in claim 12.

17. A vehicle comprising structural or safety parts or an engine manufactured according to the method claim 16.

18. A steel for forging mechanical parts comprising a composition of the following elements, expressed in percentage by weight:

0.15%≤C≤0.22%;
1.6%≤Mn≤2.2%;
0.6%≤Si≤1%;
1%≤Cr≤1.5%;
0.01%≤Ni≤1%;
0%≤S≤0.06%;
0%≤P≤0.02%;
0%≤N≤0.013%;

and optionally one or more of the following elements in percentage by weight:

0%≤Al≤0.06%;
0.03%≤Mo≤0.1%;
0%≤Cu≤0.5%;
0.01%≤Nb≤0.15%;
0.01%≤Ti≤0.03%;
0%≤V≤0.08%;
0.0015%≤B≤0.004% 0%≤Sn≤0.1%;
0%≤Ce≤0.1%;
0%≤Mg≤0.010%;
0%≤Zr≤0.010%;

a remainder of the composition being composed of iron and unavoidable impurities caused by processing, a microstructure of the steel by area percentage comprising a cumulative presence of residual austenite and martensite-austenite islands between 1% and 20%, a remainder of the microstructure being bainite of at least 80%, wherein a fraction of grain boundaries of bainite with a misorientation angle of 59.5° being more than 9%, the microstructure having an optional presence of martensite between 0% and 10%, wherein the sheet has a yield strength of 889 MPa or more.

19. The steel as recited in claim 18 wherein the steel is in the form of a sheet having an impact toughness equal to or greater than 70 J/cm$^2$.

20. The steel as recited in claim 18 wherein the sheet an ultimate tensile strength of 1150 MPa.

* * * * *